US006935462B2

(12) United States Patent
Remmers

(10) Patent No.: US 6,935,462 B2
(45) Date of Patent: Aug. 30, 2005

(54) COLLAPSIBLE SUPPORT ASSEMBLY

(76) Inventor: Dennis Remmers, 166 Pullman Rd., LaVernia, TX (US) 78121

( * ) Notice: Subject to any disclaimer, the term of this patent is extended or adjusted under 35 U.S.C. 154(b) by 0 days.

(21) Appl. No.: 10/649,349

(22) Filed: Aug. 26, 2003

(65) Prior Publication Data

US 2005/0045422 A1 Mar. 3, 2005

(51) Int. Cl.[7] ..... E04G 1/34; E04G 1/32; E04G 1/00

(52) U.S. Cl. ..... 182/153; 182/225; 182/181.1

(58) Field of Search ..... 182/151, 153, 182/131.1, 225, 224, 186.5, 182.4, 155, 186.2, 186.1

(56) References Cited

U.S. PATENT DOCUMENTS 5,020,634 A * 6/1991 Gunderson et al. ..... 182/182.4
5,404,962 A * 4/1995 Carter ..... 182/153
6,419,048 B1 * 7/2002 Robinson et al. ..... 182/182.1
6,564,903 B2 * 5/2003 Krajec ..... 182/153

* cited by examiner

*Primary Examiner*—Hugh B. Thompson, II
(74) *Attorney, Agent, or Firm*—David Henry

(57) ABSTRACT

A lightweight and portable, yet strong and stable support device formed from a horizontal support member, a set of leg members, and a collapsible attachment mechanism. The present device is easily modified between its collapsed and support position, thereby providing for efficient and use. In its collapsed position, the device may be easily moved from place to place. In its extended position, the device provides for excellent stability in withstanding sheer and lateral forces with respect to its support frame.

3 Claims, 4 Drawing Sheets

COLLAPSIBLE SUPPORT ASSEMBLY

BACKGROUND OF THE INVENTION

1. Field of the Invention

The present invention generally relates to a sawhorse, and more particularly, a sawhorse that is fully collapsible and portable, yet stable. The sawhorse of the present invention is particularly beneficial in withstanding lateral and sheer forces with respect to its support frame, providing a structure that has an excellent strength to weight ratio, and providing a device that may be efficiently used in virtually all real-world conditions.

2. Background of the Invention

Sawhorses are one the most common tools known to mankind. In fact, these devices are used by handyman, carpenters, electricians, and just about every other skilled worker the world over. Efficient construction of virtually every residential or commercial building in all of industrialized society relies on the use of these devices.

In light of the vast use of sawhorses in the construction of virtually every newly erected structure, improvements in these devices may create an enormous cumulative benefit. For instance, it is easily seen that if one worker, or group of workers, is able to derive some decrease in project completion time—that time saving benefit may be reproduced with every project of every job, with every worker or group of workers. The resulting cumulative benefit, or the tremendous time and cost saving provided, would be too large to calculate.

Obviously, in light of their enormous popularity, sawhorses are known in the art. And, while some invention are more beneficial than others, no known product is able to achieve the range or level of improvements, in one device, created by the present invention. For instance, a majority of sawhorses known in the art are made of wood, most of these devices rely on the use of 2×4's as their primary component. These products, such as those found in U.S. Pat. Nos. 4,926,966 and 4,570,752 may provide adequate support, are limited in view of the present device. That is, such devices are not easily portable and are often not stable when subjected to forces exerted on the device in any direction other than along the direction of gravity.

On the other end of the spectrum, there are devices like those taught in U.S. Pat. No. 5,305,850. While these devices are more easily moved, they fail to provide an adequate strength to weight ratio and are no more to likely withstand various forces exerted upon the frame. As such, these devices would be suspect during heavy-duty use.

The present invention, through its highly unique design, is able to offer a range and level of benefits not previously possible with known products. For instance, the present device is lightweight and portable, yet sturdy enough for the heaviest of use. Further, construction of the present device provides a highly efficient way of collapsing and stabilizing the support frame. Also, the unique design of the present device provides an excellent strength to weight ratio.

Finally and most importantly, the stabilizing mechanism of the present invention allows the device to withstand forces not perpendicular to the plane of the support frame. That is, the present invention provides a device that is excellent at withstanding any combination of sheer or lateral forces with respect to the support frame.

In light of the shortcomings of the device known in the art, and the unique benefits provided by the present invention, it is easily seen that there is a tremendous need for a such as that of the present invention.

SUMMARY OF THE INVENTION

In view of the foregoing, it is an object of the present invention to provide a sawhorse that is excellent for withstanding any combination of sheer and lateral forces with respect to its support frame.

It is another object of the present invention to provide a sawhorse that has an excellent strength to weight ratio.

It is another object of the present invention to provide a sawhorse that is durable.

It is another object of the present invention to provide a sawhorse that is easily collapsed.

It is another object of the present invention to provide a sawhorse that is easily constructed.

It is another object of the present invention to provide a sawhorse that is lightweight.

It is another object of the present invention to provide a sawhorse that is portable.

It is another object of the present invention to provide a sawhorse that is cost-effective.

In satisfaction of these and related objects, the present device provides a portable, yet extremely stable sawhorse that may can be used efficiently in virtually any construction-type project.

Practice of the present invention involves a horizontal support member that is attached at each end, by collapsible attachment means, to a set of first and second leg members.

The collapsible attachment means is comprised of a first and second horizontal flange, which are connected by a common base. The horizontal flange base extends between each horizontal flange, connecting to both at their bottom side. First and second horizontal flanges are pivotally mounted to the front and back of the horizontal support beam and contain at least one hole through which a pivot pin is inserted. The pivot pin traverses each horizontal flange and the horizontal support beam so as to provide a point by which the collapsible attachment means (and therefore the adjoined leg members) may be reversibly rotated from a vertical support position to a collapsed position.

Extending in a substantially perpendicular direction from said first and second horizontal flange is a leg member support frame. Each leg member support frame consists of a first and second plate and a first and second limiting flange. Each leg member support frame serves to receive a set of first and second leg members and to hold the leg members in a stable support position or allow them to be fully collapsed.

Each first and second plate of each leg member support frame contains at least one hole so as to receive a pivot pin that traverses each plate and a leg member so as to allow the leg members to rotate between a first and second position where the first position is a collapsed position where the leg members are juxtaposed to one another so that each is substantially parallel to the other and the second position is a support position where each leg member rests against the first or second limiting flange.

Importantly, a support piece is mounted to each first limiting flange. The support piece, at its top portion, is formed into an insert pin that reversibly engages a horizontal flange and the horizontal support member. In the engaged position, the support piece imparts extraordinary support to the device. At its bottom portion, the support piece is resistively pressed away from said first limiting flange, perhaps by a spring. The support piece may be depressed on its bottom end to disengage the support piece from the horizontal flange and the horizontal support member. Upon support piece disengagement, the collapsible attachment means (and therefore the adjoined leg members) may be moved to its collapsed position.

DETAILED DESCRIPTION OF THE PREFERRED EMBODIMENT

Figure 1:
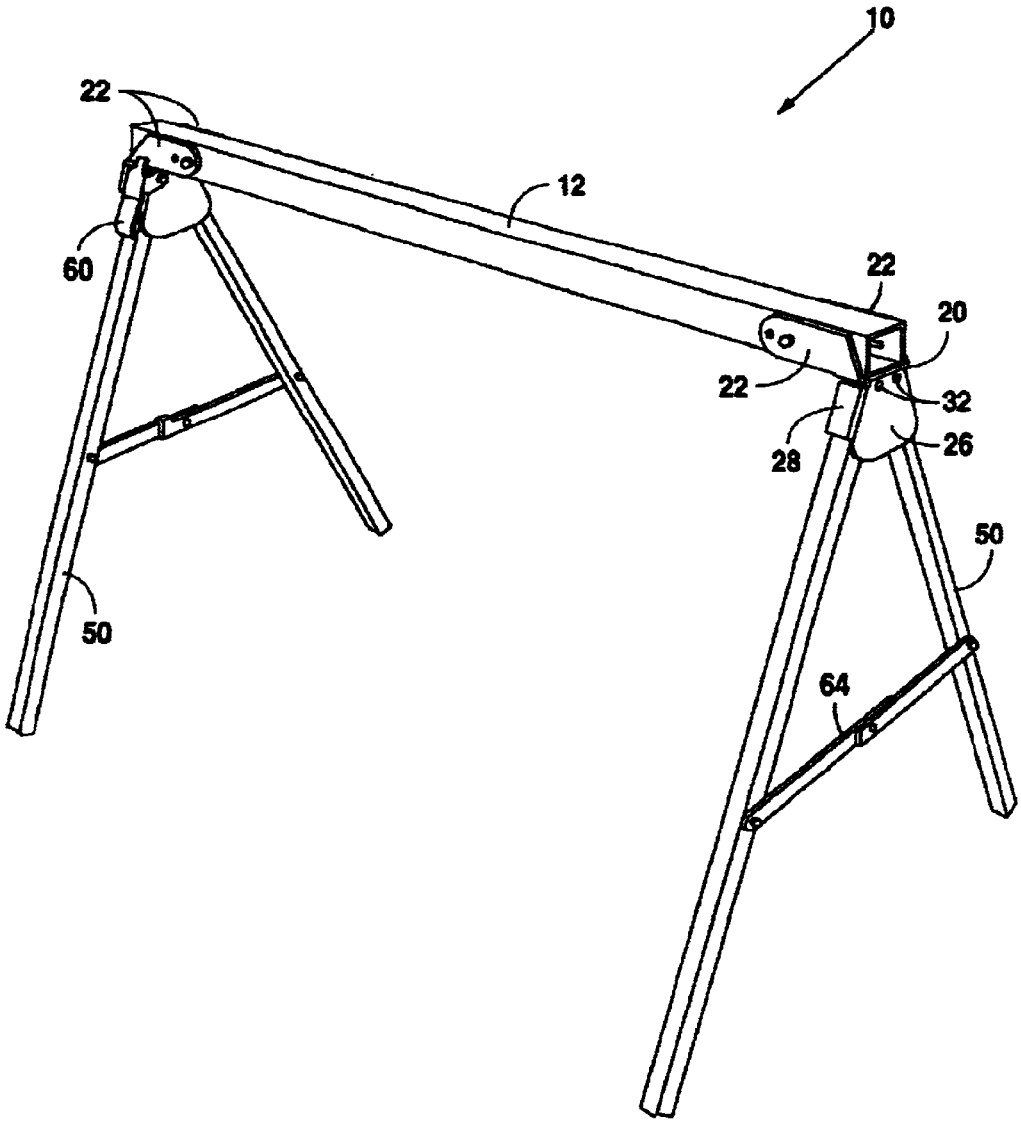
FIG. 1 is a perspective view of the device of the present invention in its expanded, support position
Figure 2:
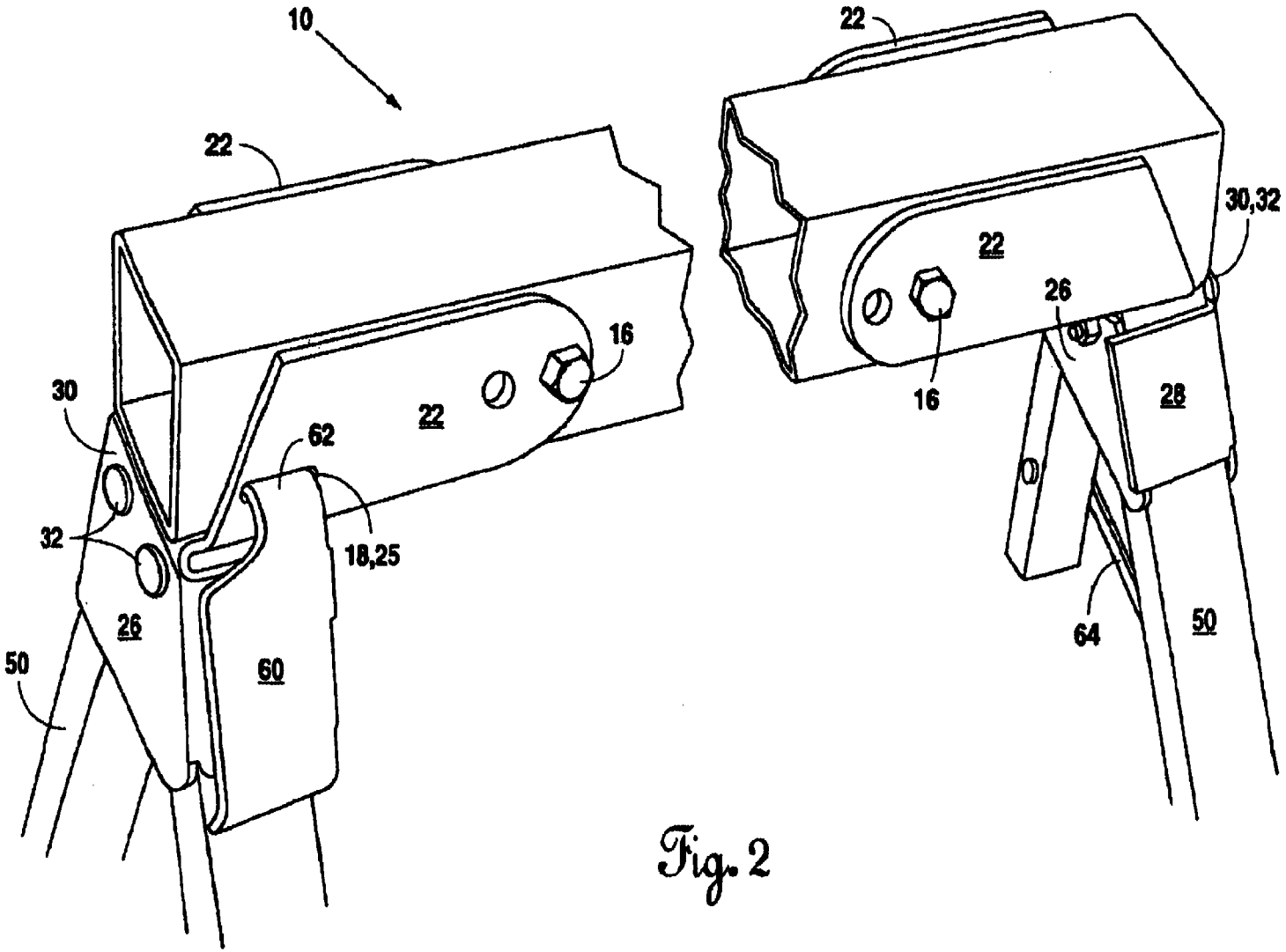
FIG. 2 is a cross section view of the device of the present invention.
Figure 3:
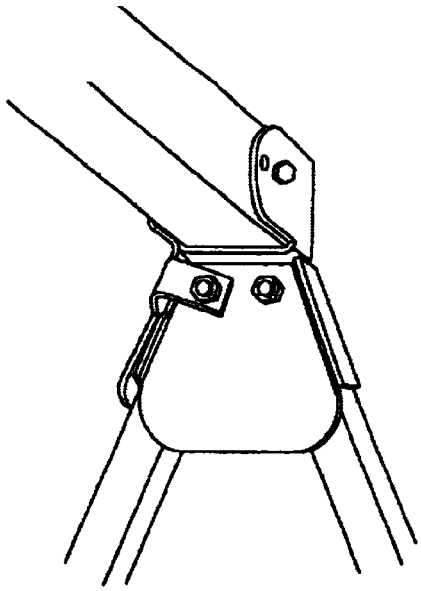
FIG. 3 is a sagittal view of the device of the present invention.

Referring in combination to FIGS. 1–6, and particularly FIGS. 1 and 2, the device of the present invention is generally referred to by numeral 10. Device 10 may be primarily constructed from any suitably rigid material that is lightweight, yet strong enough to support reasonably expected loads. It is easily seen that successful embodiments of the present invention may be constructed primarily from high strength plastic, fiberglass, or some composite. In the preferred embodiment, device 10 is constructed primarily from aluminum.

At its upper-most portion device 10 contains horizontal support member 12. In the preferred embodiment horizontal support member 12 contains, at each end, a set of pivot pin holes for receiving pivot pins 16 and a support piece slot 18 (best illustrated in FIG. 6) meant for receiving support piece 60.

Figure 4A:
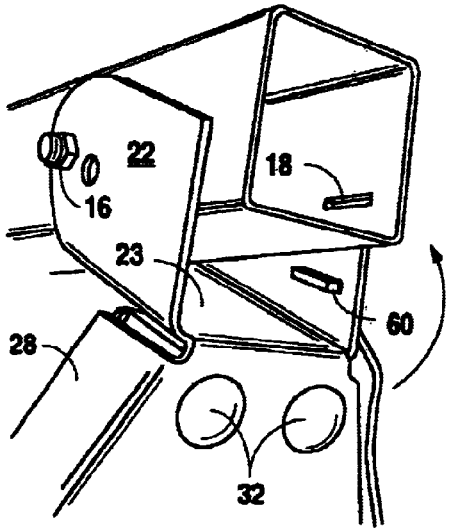
FIG. 4*a* is a demonstrative view of the collapsible attachment means of the present device.
Figure 4B:
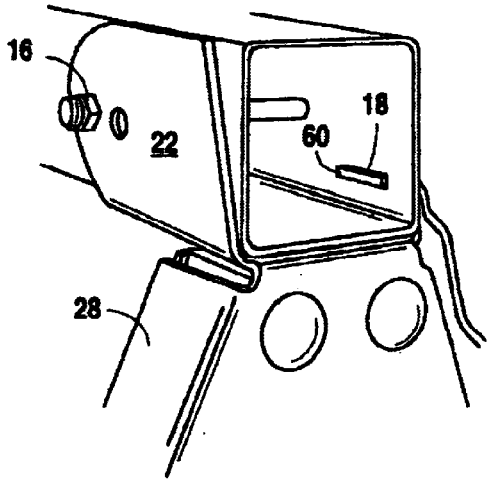
FIG. 4*b* is a demonstrative view of the collapsible attachment means of the present device in its support position.
Figure 5:
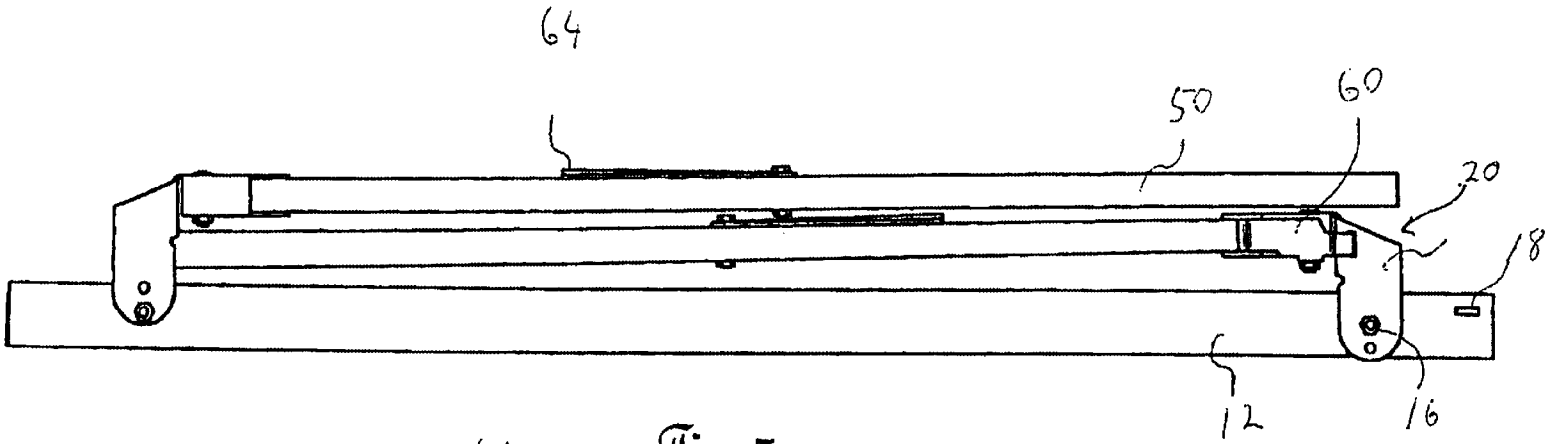
FIG. 5 is a perspective view of the device of the present invention in its fully collapsed position.
Figure 6:
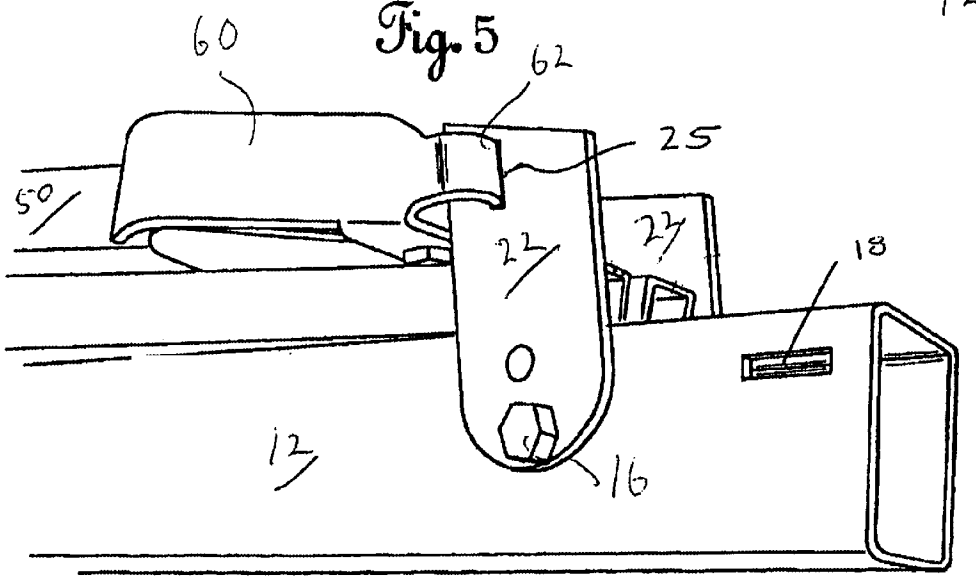
FIG. 6 is a perspective of the collapsible attachment means of the present invention.

Attached at each end of horizontal support member 12 is collapsible attachment means 20. In the preferred embodiment, each collapsible attachment means 20 is comprised of a first and second horizontal flange 22 which are joined together by base member 23 (as best illustrated in FIG. 4*a*). Base member 23 extends under horizontal member 12 between each horizontal flange and attaches at their bottom side.

Each horizontal flange 22 contains a pivot pin hole meant for receiving pivot pin 16. Each horizontal flange 22 is attached to horizontal support member 12 at pivot pin hole by pivot pin 16. Pivot pin 16 traverses each horizontal flange 22 and horizontal support 12 member so as to provide a point by which collapsible attachment means 20 may be reversibly rotated with respect to horizontal support member 12.

Collapsible attachment means 20 is further comprised of first and second plates 26, which face opposite each other, and a first and second divergently spread side wall flange 28. Plates 26 and side wall flanges 28 extend in a substantially perpendicular direction from horizontal support flanges 22. First and second plates 26 and first and second side wall flanges 28 are joined at right angles to one another so as to define an enclosure with an open bottom end for receiving leg members 50. In the preferred embodiment first and second plates 26 are tapered towards their top end and broaden toward their bottom ends so as to enable each side wall flange 28 to rest at an angle to support each leg member 50 in a fully expanded support position.

First and second plates 26 each contain at least one pivot pin hole 30 for receiving pivot pin 32. In the preferred embodiment, pivot pin 32 traverses plates 26 and leg member 50 so as to provide a point by which leg member 50 may reversibly rotate between a first collapsed position and a second fully extended, support position.

As best illustrated in FIG. 2, support piece 60 is pivotally mounted to one side wall flange 28. As seen in FIG. 2, support piece 60, at its top portion, is formed into an insert pin 62 that reversibly engages horizontal flange 22 at slot 25, and horizontal support member 12 at slot 18. In the engaged position, the support piece imparts extraordinary support to device 10. At its bottom portion, support piece 60 is resistively pressed away from side wall flange 28. In the preferred embodiment this is done by some resistive device such as a spring (not shown in the drawings). Support piece 60 may be depressed on its bottom end to disengage support piece 62 from horizontal flange 22 and horizontal support member 12. Upon disengagement of support piece 60, collapsible attachment means 20 (and therefore the adjoined leg members) may be moved to its collapsed position.

Extending from, and pivotally attached to plates 26 is a pair of individual leg members 50. Leg members 50 may be adjusted between collapsed and support positions. In the support position (FIGS. 1–4), each leg member 50 rests against side wall flange 28. In the collapsed position (FIGS. 5–6), leg members 50 rest substantially parallel to one another.

In the preferred embodiment, a hinged strap 64 extends between each leg member 50 so as to provide further support and further prevent the leg members from spreading too far apart. As the leg members 50 move toward one another, strap 64 collapses at its hinge point. Alternative embodiments are envisioned where strap 64 is in the form of some semi-rigid or rope material that may also perform the intended functions.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A collapsible support assembly, comprising:

a horizontal support beam having a pair of locking tab apertures;

a first and a second pivotal leg support means pivotally attached to said horizontal support beam for moving between first collapsed position and a second deployed position, such movement of said first and second pivotal leg support means being substantially co-planer with a long axis of said horizontal support beam;

a first and a second pair of leg members attached to said first and second pivotal leg support means, respectively, whereby said first pair and said second pair of leg members are movable between a collapsed pair position, whereby said first and second pair of leg members are closely juxtaposed along said horizontal support beam, and an expanded pair position, whereby said first and second pair of leg members extend in substantially perpendicular fashion from the long axis of said support beam;

said first and second pair of leg members each having a first and a second leg member wherein said first and second leg members of the first pair of leg members pivotally attached to said first pivotal leg support means, wherein said first and second leg members of the second pair of leg members pivotally attached to said second pivotal leg support means, whereby each of said first and second leg members are movable between a first compact leg position, whereby each of said first and second leg members are closely juxtaposed along their lengths, and a second leg expanded position whereby each of said first and second leg members extend divergently from the respective said pivotal leg support means, such movement of each of said first and second leg members being substantially orthogonal to the long axis of said horizontal support beam;

a first leg release tab member and a second leg release tab member pivotally attached to respective said first and second pivotal leg support means, respectively, and each of which include a locking tab member positioned, relative to said horizontal support beam, for reversibly engaging said respective locking tab aperture of said horizontal support beam when said first and second pivotal leg support means are positioned in said second deployed position.

2. The collapsible support assembly of claim 1 further comprising biasing means for biasing said leg release tab members to pivot toward said engaging of said respective locking tab aperature of said horizontal support beam.

3. The collapsible support assembly of claim 1 further comprising a first restrictive support member extending between said first and second leg members of the first pair of leg members and a second restrictive support member extending between said first and second leg members, of the second pair of leg members each configured to pivot about a central point between a closed position and an extended position.

* * * * *